US012222191B2

(12) United States Patent
Hall

(10) Patent No.: US 12,222,191 B2
(45) **Date of Patent: *Feb. 11, 2025**

(54) AUTOMATED FIRE CONTROL DEVICE

(71) Applicant: Christopher J. Hall, Satellite Beach, FL (US)

(72) Inventor: Christopher J. Hall, Satellite Beach, FL (US)

(73) Assignee: Christopher J. Hall, Satellite Beach, FL (US)

( * ) Notice: Subject to any disclaimer, the term of this patent is extended or adjusted under 35 U.S.C. 154(b) by 8 days.

This patent is subject to a terminal disclaimer.

(21) Appl. No.: 18/130,385

(22) Filed: Apr. 3, 2023

(65) Prior Publication Data

US 2023/0314102 A1 Oct. 5, 2023

Related U.S. Application Data

(63) Continuation of application No. 13/861,339, filed on Apr. 11, 2013, now Pat. No. 10,782,097.
(Continued)

(51) Int. Cl.
*F41G 3/00* (2006.01)
*F41A 19/58* (2006.01)
(Continued)

(52) U.S. Cl.
CPC ..... *F41G 3/00* (2013.01); *F41A 19/58* (2013.01); *F41A 19/64* (2013.01); *F41G 1/473* (2013.01);
(Continued)

(58) Field of Classification Search
CPC ... F41G 3/00; F41G 1/473; F41G 3/06; F41G 3/08; F41G 3/12; F41G 3/165; F41A 19/58; F41A 19/64
See application file for complete search history.

(56) References Cited

U.S. PATENT DOCUMENTS 3,008,668 A 11/1961 Darlington
3,881,824 A 5/1975 Higgins
(Continued)

FOREIGN PATENT DOCUMENTS

EP 0898144 2/1999
GB 2255398 A 11/1992
(Continued)

OTHER PUBLICATIONS

PCT International Search Report and Written Opinion of International Searching Authority mailed Aug. 27, 2014 corresponding to PCT International Application No. PCT/US2014/033629 filed Apr. 14, 2014.

*Primary Examiner* — Michelle Clement
(74) *Attorney, Agent, or Firm* — John L. DeAngelis; Wolter Van Dyke Davis, PLLC

(57) ABSTRACT

A device that causes a weapon to fire upon a target when the weapon is enabled by an operator, and when the weapon point of impact passes through a target or in a proximity thereto and when the target satisfies certain criteria as determined by one or more sensors/designations.
This invention represents a significant paradigm shift. Some prior art (large scale) weapons automatically acquire/track/prioritize/target/fire upon targets without operator intervention (i.e. Phalanx). Most prior art weapons, especially but not limited to small arms, are manually aimed, and fire immediately upon an input (trigger pull, or equivalent) from the operator. The current invention is a novel approach which triggers the release of a round, multi-round burst, rocket, missile, or other projectile(s) when enabled by the operator, and when the target passes through the point of impact (or desired/computed proximity thereto), relieving the operator of the split second judgment in timing the release and/or cessation of such fire. The results intended include a reduction in off-target rounds fired, increased hit
(Continued)

rate, conservation of ammunition, more effective targeting for non-motion-stabilized weapons (in particular small/medium arms), and the introduction of a backup mode for nominally motion-stabilized weapons which may allow effective operations when primary stabilization systems fail or are overwhelmed by dynamics.

This invention is applicable (in embodiments of varying complexity) to weapons ranging from handheld pistols to the main (artillery) gun of a tank, a ship, or the cannon aboard an aircraft.

24 Claims, 3 Drawing Sheets

Related U.S. Application Data

(60) Provisional application No. 61/623,057, filed on Apr. 11, 2012.

(51) Int. Cl.

| | |
|---|---|
| ***F41A 19/64*** | (2006.01) |
| ***F41G 1/473*** | (2006.01) |
| ***F41G 3/06*** | (2006.01) |
| ***F41G 3/08*** | (2006.01) |
| ***F41G 3/12*** | (2006.01) |
| ***F41G 3/16*** | (2006.01) |

(52) U.S. Cl.

CPC ..... *F41G 3/06* (2013.01); *F41G 3/08* (2013.01); *F41G 3/12* (2013.01); *F41G 3/165* (2013.01)

(56) References Cited

U.S. PATENT DOCUMENTS

| | | | |
|---|---|---|---|
| 4,128,837 | A | 12/1978 | Page |
| 4,146,780 | A | 3/1979 | Sprey |
| 4,402,250 | A | 9/1983 | Baasch |
| 4,494,198 | A | 1/1985 | Smith |
| 4,760,397 | A | 7/1988 | Piccolruaz |
| 4,783,744 | A | 11/1988 | Yueh |
| 4,787,291 | A | 11/1988 | Frohock |
| 5,214,433 | A | 5/1993 | Alouani |
| 5,392,688 | A | 2/1995 | Boutet |
| 5,431,084 | A | 7/1995 | Fowler |
| 5,483,865 | A | 1/1996 | Brunand |
| 5,949,015 | A | 9/1999 | Smith |
| 5,966,859 | A | 10/1999 | Samuels |
| 5,974,940 | A | 11/1999 | Madni |
| 6,038,955 | A | 3/2000 | Thiesen |
| 6,043,867 | A | 3/2000 | Saban |
| 6,174,288 | B1 | 1/2001 | Samuels |
| 6,260,466 | B1 | 7/2001 | Humphreys |
| 6,301,371 | B1 | 10/2001 | Jones |
| 6,497,171 | B2 | 12/2002 | Gerber |
| 6,672,534 | B2 | 1/2004 | Harding |
| 6,785,996 | B2 | 9/2004 | Danner |
| 6,871,439 | B1 | 3/2005 | Edwards |
| 6,886,287 | B1 | 5/2005 | Bell |
| 6,973,865 | B1 | 12/2005 | Duselis |
| 7,055,276 | B2 | 7/2006 | McPherson |
| 7,089,844 | B2 | 8/2006 | Becker |
| 7,089,845 | B2 | 8/2006 | Friedli |
| 7,210,392 | B2 | 5/2007 | Greene |
| 7,552,669 | B1 | 6/2009 | Denis |
| 7,739,823 | B2 | 6/2010 | Shapira |
| 7,810,273 | B2 | 10/2010 | Koch |
| 7,870,816 | B1 | 1/2011 | Willingham |
| 7,886,648 | B2 | 2/2011 | Williams |
| 7,966,763 | B1 | 6/2011 | Schneider |
| 8,020,769 | B2 | 9/2011 | Papale |
| 8,074,555 | B1 | 12/2011 | Sullivan |
| 8,141,473 | B2 | 3/2012 | Kude |
| 8,172,139 | B1 | 5/2012 | McDonald |
| 8,286,872 | B2 | 10/2012 | Laupstad |
| 8,336,438 | B2 | 12/2012 | Compton |
| 8,833,231 | B1 | 9/2014 | Venema |
| 8,936,193 | B2 | 1/2015 | McHale |
| 9,366,503 | B2 | 6/2016 | Schmidt |
| 2004/0050240 | A1 | 3/2004 | Greene |
| 2005/0219690 | A1 | 10/2005 | Lin |
| 2006/0005447 | A1 | 1/2006 | Lenner |
| 2006/0048427 | A1 | 3/2006 | Crandall |
| 2006/0266203 | A1 | 11/2006 | Herman |
| 2007/0057842 | A1 | 3/2007 | Coleman |
| 2007/0234626 | A1 | 10/2007 | Murdock |
| 2008/0121097 | A1 | 5/2008 | Rudakevych |
| 2010/0186277 | A1 | 7/2010 | Beckmann |
| 2011/0010981 | A1 | 1/2011 | Wieland |
| 2011/0089325 | A1 | 4/2011 | Ottney |
| 2012/0037702 | A1 | 2/2012 | Kude |
| 2012/0042559 | A1 | 2/2012 | Bockmon |
| 2012/0132709 | A1 | 5/2012 | Lowrey |
| 2012/0188078 | A1 | 7/2012 | Soles |
| 2012/0297658 | A1 | 11/2012 | Lupher |
| 2012/0314283 | A1 | 12/2012 | Jahromi |
| 2013/0028486 | A1 | 1/2013 | Backlund |
| 2014/0028856 | A1 | 1/2014 | Ehrlich |

FOREIGN PATENT DOCUMENTS

| | | |
|---|---|---|
| WO | 2006096183 | 9/2006 |
| WO | 2012121735 | 9/2012 |

AUTOMATED FIRE CONTROL DEVICE

RELATED APPLICATIONS

This patent application is a continuation of the patent application filed on Sep. 21, 2020 and assigned application Ser. No. 17/027,152, now U.S. Pat. No. 10,782,097, which is a continuation of the patent application filed on Apr. 11, 2013 and assigned application Ser. No. 13/861,339, now U.S. Pat. No. 10,782,097, which claims the benefit of Provisional Patent Application No. 61/623,057 filed on Apr. 11, 2012, the contents of all related applications are incorporated by reference herein.

BACKGROUND OF THE INVENTION

The inventor is a (combat style) target shooter. I have been inactive for years, and recently, went to the range to test a new rifle before getting 'back in the game' at the local club.

As I was badly out of practice, I was able to not just operate instinctively, but actually observe and analyze my own (practiced but 'rusty') actions firing the first rapid fire strings with my new AR-15 style rifle (with a red dot optical sight). Firing 30 round strings, shooting as fast as I could with accuracy, I found that I was trying to press the trigger as I passed through the target center (the center of the 'A Zone'). That is, I observed that I was trying to fire as the point of impact (POI) passed through the 'center of mass' in whatever direction I passed it, (vertically, diagonally, or horizontally) as my aim wavered due to recoil and other factors. This requires split second timing in order to trigger each shot both quickly and with accuracy.

Currently, various sights are in use for military and/or civilian weapons, including optical, IR (infrared), starlight (light amplification), thermal, thermal plus light amplification 'fusion', electro-optic, and/or other 'enhanced vision' modes, sometimes with integrated target ranging (often laser ranging) to allow compensation for such factors as bullet drop with range. (Heavy weapons including vehicular, tank, aircraft or shipboard cannons may have radar, lidar, laser ranging, and/or other target designating and/or tracking technologies to provide a corrected point of aim that yields the desired point of impact on a target.) It is up to the weapon operator to pull the trigger and fire the weapon (especially in rapid fire or at long ranges) as the POI (essentially point of aim as corrected for range, and/or other factors, as available) passes through the target. Recoil recovery from the previous shot(s), breathing, pulse bounce, normal aiming waver, wind, and/or other factors disturb the POI. Similar disturbances in aim apply for almost all weapons, from handguns to aircraft/tank mounted cannons, unguided rockets, etc.

BRIEF DESCRIPTION OF THE FIGURES

Various features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
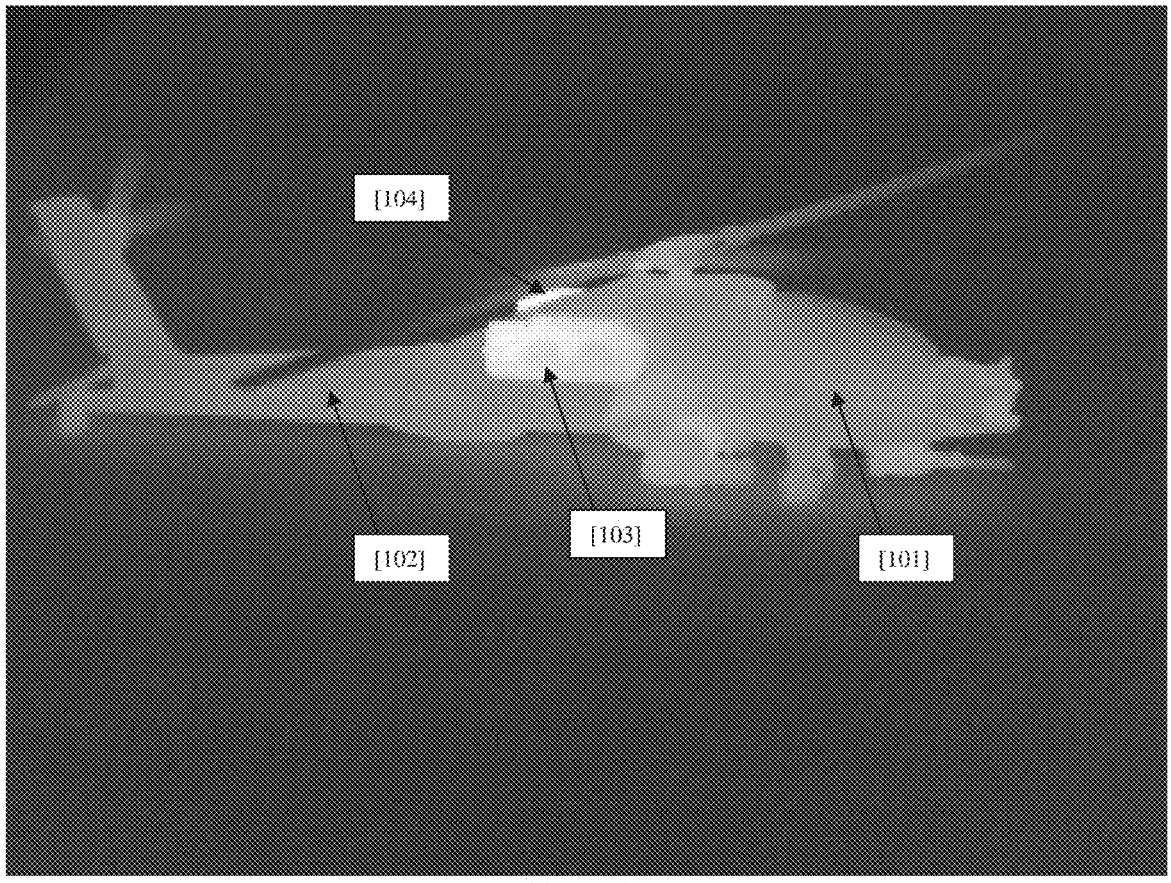
FIG. 1 illustrates a thermal image of a helicopter.

Before describing in detail exemplary fire control devices, it should be observed that the present invention resides primarily in a novel and non-obvious combination of elements. So as not to obscure the disclosure with details that will be readily apparent to those skilled in the art, certain conventional elements have been presented with lesser detail, while the drawings and the specification describe in greater detail other elements pertinent to understanding the invention.

The following embodiments are not intended to define limits as to the structure of the invention, but only to provide exemplary constructions. The described embodiments are permissive rather than mandatory and illustrative rather than exhaustive.

The current invention provides automatic release of a shot, burst, shell, rocket, missile, etc. as the target passes through the weapons' point of impact, i.e., the point where the shot, burst, etc. will intersect the target. This feature relieves the operator of the split second timing of trigger pull (including other manual triggering/release methods) needed to assure the projectile(s) impact(s) the desired target with a high probability.

In some embodiments, the current invention may utilize available/applicable data, including but not limited to enhanced vision, ranging, radar, wind data, and/or motion to allow the operator to 'press the trigger' (i.e., to enable the automatic firing mode) PRIOR to the point of impact crossing the desired target. This action by the shooter will permit the shot, burst, etc. to be automatically released immediately, or later as the weapons' point of impact crosses through the target.

Thus, as the point of impact wavers through a target, a weapon utilizing the current invention will (when enabled by the operator) fire itself, provided the target meets 'shoot' criteria such as a thermal signature consistent with body heat, engine heat, shape, etc. (Including in some embodiments; a target designation; indication whether the target is friend or foe; or other target parameters indicating whether the target should be fired upon, etc.) and the operator allows or enables release with an action such as pulling/holding the trigger down (or activating another component that enables the automatic firing mode).

In one embodiment, the weapon will cease firing (if in the full-automatic, machine gun mode) as the target leaves the point of impact, even though the trigger may still be manually pulled by the operator. In another embodiment the weapon remains in the automatic firing mode whenever the trigger is manually pulled by the shooter, notwithstanding that the target is no longer at the point of impact. In yet another embodiment the weapon resumes firing as a target (the same one, or a different target) again enters the point of impact, provided the trigger is still pulled or the operator has otherwise engaged the automatic firing mode as described above. To avoid classification under the National Firearms Act (NFA) as a machine gun (in some embodiments), release of subsequent shots may require releasing and pulling the trigger again before more than one shot is fired. This latter feature would permit sales to civilians, whereas new NFA weapons may only be salable to police/military.

In small arms applications, the current invention may omit some data such as wind, range, etc. while in applications such as vehicle/aircraft cannons/machine guns, information regarding motion, ranging, wind, etc. (derived from laser ranging, radar, FLIR (forward looking infrared) and/or other applicable systems for predicting point of impact) may be used. The net result of use of the current invention may include improved hit probability while conserving ammunition i.e., shooting only when the target intersects or passes through a given proximity to the point of impact. This feature of the current invention may be of great importance where ammunition consumption is rapid and supply is limited, for example in a jet fighter with a rapid fire cannon and only enough ammunition for seconds of firing. Ammunition waste off-target may be a life-or-death issue in a dogfight or other situations.

Based on the disadvantages of known sighting and firing techniques, clearly, a weapon that fires automatically (not necessarily in the sense of National Firearms Act 'full auto' or 'machine gun' fire) as its Point Of Impact (POI) passes through the target (or proximity to its' centroid, or other calculated preferred impact region) would be useful, as it would not rely on the shooter to trigger the shot(s) at exactly the right moment as he/she wavers through the desired target (or target region) while trying to aim.

Herein, for the purposes of definition, POI (point of impact) may refer to the point of aim (POA) such as the point at which the weapon's sight indicates the target is centered, perhaps the axis at which the weapon's bore is directed (less parallax, typically in short range, small arms applications), or POI may include corrections to the POA for factors including but not limited to: projectile drop (based on range to target, ballistic coefficient, velocity, etc.), wind, altitude, temperature, relative humidity, target lead due to motion of either the firing platform and/or target (the latter typically with larger weapons and/or longer ranges), or any other factors that cause the point of aim to diverge from the point of impact. If compensation data is available (as a non-limiting example, in a fighter aircraft where the target may be angle, velocity, and range tracked and designated by tracking radar) POI and POA may be somewhat interchangeable from the viewpoint of the operator, as POI may actually be presented visually on a heads up display as a corrected point of aim to the pilot.

Prior art military/civilian weapons have video, thermal, infrared, light amplification, electro-optic, combined modes (for instance light amplification plus thermal/thermal target outline overlaid) and/or comparable (for instance radar/lidar/electro optic) enhanced vision devices that show a target clearly, and/or in adverse weather, night and/or day conditions against a variety of backgrounds.

The current invention utilizes such existing enhanced vision (or comparable sensor technology, to include all of the aforementioned technologies) to identify a target (one meeting a defined criteria) against a background, and trigger the firing of a weapon as its' POI passes through the target, or near the presumed 'best' POI region, usually, but not limited to the 'center of mass', engine, or another feature of the target.

FIG. 1 shows an Apache helicopter, taken in Infrared. (White is hottest in this image.) The airframe [101] and [102} is visible as slightly warmer than the background. Sophisticated image processing software could identify a target region in this image (from random angles, not just a profile) as any portion, or all, of the airframe. On the other hand, the engines [103] and, partially hidden engine [104] stand out clearly as hottest in the image, and even relatively simple, small arms embodiments of the current invention could see the engines as the target region 'blob' to fire upon, or to fire near the estimated region between and including both engines, in aspect angles where both are visible.

Figure 2:
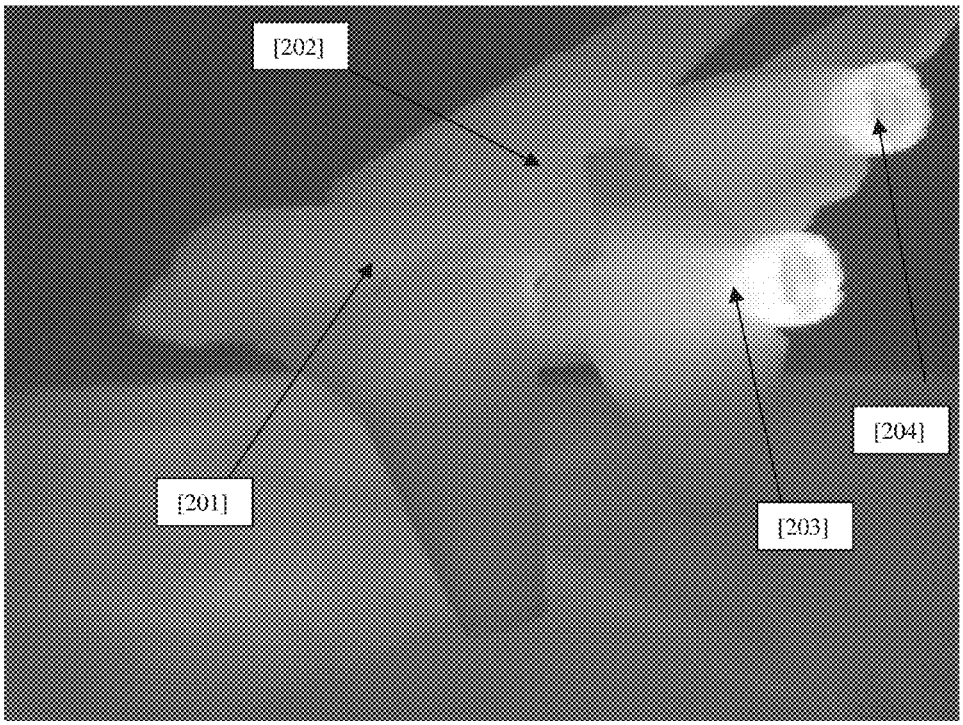
FIG. 2 illustrates a thermal image of a twin-engine fighter.

FIG. 2 shows an infrared image of a twin engine fighter, again with the airframe [201] and [202] clearly identifiable against the background. Again, sophisticated embodiments of the current invention could identify the outline and central region of the aircraft, or a proximity to it, that would constitute the firing region or 'blob'. Simpler embodiments may simply respond to the engines [203] and [204] as they are the hottest items in the field of view, and fire at, between, or in a certain proximity to, these engines when enabled.

This invention may be used with handguns, shoulder-fired weapons, or heavier (bipod, tripod, pintle, fixed, vehicle/airframe mounted, etc.) weapons, with manually loaded, semiautomatic, and/or fully-automatic firing. The size, capability, complexity and implementation of this invention may vary with weapon type. It may also be applicable to cannon/machine gun fire from a moving tank, vehicle, ship, or aircraft, as an alternative to a fully-stabilized gun, or as a backup when full stabilization fails.

If a weapon fires as its' POI passes through the desired target, it is likely to strike that target. A significant objective for this invention is to relieve the operator of the (often milliseconds long) decision when to trigger the weapon as the point-of-impact passes through a target. The key is to fire the weapon as the wavering POI passes through that target.

The gist of this invention is that the weapon (and attached or associated controller and/or other control technology) determines when to fire upon a perceived target, but does not necessarily aim the weapon though some embodiments may include such a feature. As a non-limiting example, at longer ranges, the enhanced vision and/or other targeting information could be used to actuate piezoelectric (or other technology) actuators to move the barrel/receiver assembly small amounts relative to the stock assembly of a rifle to bring (or hold) the POI into the desired region long enough to fire.

This invention, improperly utilized, could fire upon friendly, neutral, or hostile personnel with equal efficiency, so proper target selection remains in the hands of the operator and/or associated IFF (identify friend or foe) and/or other target designation systems.

Note that this invention is fundamentally different from weapons such as the Phalanx automatic cannon utilized for point defense on ships. (See the discussion of the differences between the present invention and Phalanx weapons system below). Phalanx selects its own target(s), aims the cannon, and fires (by itself, when enabled) without operator intervention. The current invention includes small arms use, and weapons not aimed by automated means, though a corrected point of impact may be presented to the operator in his display or sighting scope which estimates POI under the firing conditions and/or other factors—such as range to target, etc.

This invention will fire upon meeting a combination of operator and automatic conditions. The operator would select this automated mode of fire, pull a primary or secondary (the latter possibly utilized to select and enable this invention) trigger, or otherwise enable the automatically triggered fire mode, and aim the weapon at the target. When the target (or preferred area of the target) intersects the point of impact the weapon fires automatically. The step of aiming the weapon can be executed manually by the weapon operator in most embodiments, or automatically by an aiming device or aiming controller.

Figure 3:
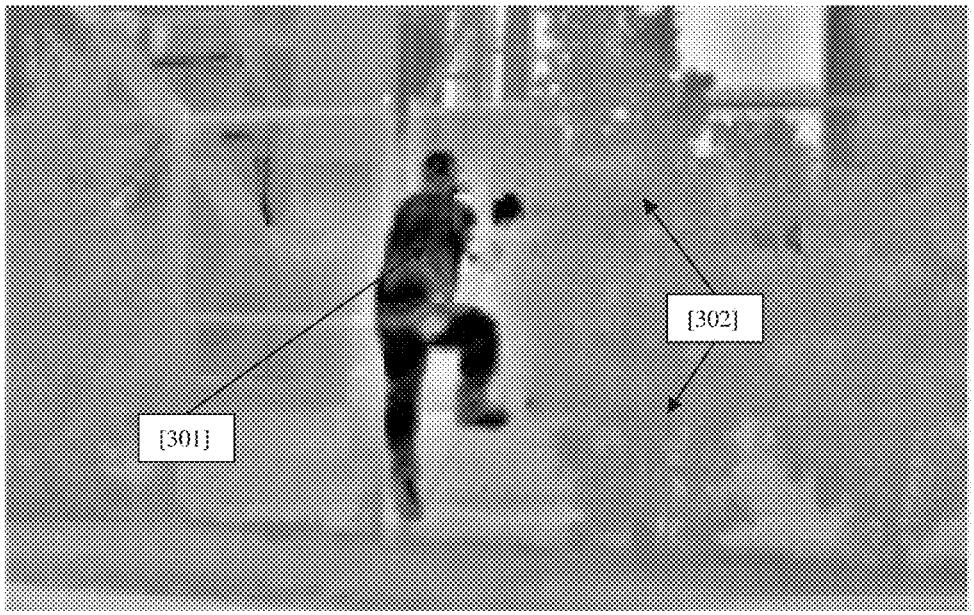
FIG. 3 illustrates a thermal image of a single person.

As a non-limiting example, consider the case of a thermal imaging or thermal/light amplification ('fusion') riflescope used for the enhanced vision source and a human target. Against most backgrounds, a human target appears clearly warmer (or colder) than the background, providing a clear contrast against most background items, as shown in FIG. 3. The human [301] shows clearly against the background [302]. Unfortunately, depending upon ambient temperature, Thermal infrared imaging alone may not provide clear contrast. Starlight (light amplification) images also do not always provide clear contrast. Recent innovations include thermal/light amplification fusion, which provides the advantages of both technologies. In some current implementations, either the outline(s) of, or region(s) corresponding to warm objects (such as the human body) are superimposed upon the light amplification image, often in color, to provide better target identification.

Figure 4:
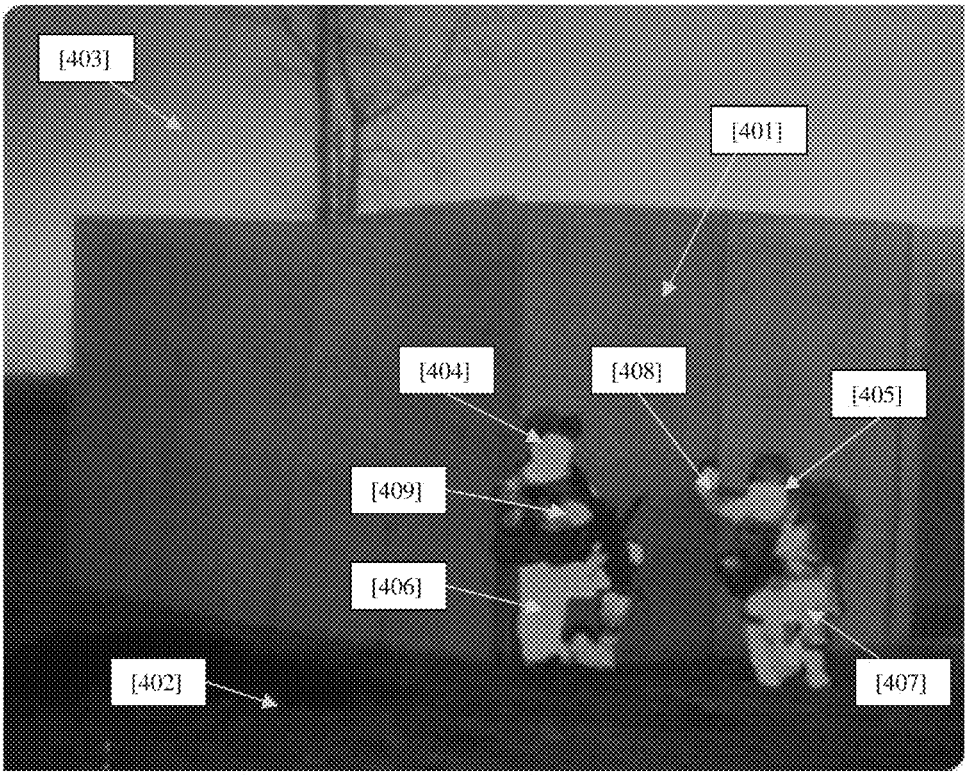
FIG. 4 illustrates a fusion image of two people.

FIG. 4 shows two men in front of a wall, in such a 'fusion' image. The wall [401], foreground [402], and background [403] are essentially the light amplified part of the image, while the heads [404], [405], lower bodies [406], [407] and hands [408], [409] stand out as overlaid thermal targets, represented as light regions (in the original image, orange against the green light amplified regions. Note too that backpacks, helmets, and bulletproof vests may appear as dark regions, as they partially obscure the human thermal signature.

In this example, the operator selects the automated fire mode, and depresses the weapon trigger. The weapon may NOT immediately fire. The invention searches the field of view for a target 'blob' having the anticipated contrast—corresponding to human body temperature in the case of a thermal riflescope, for example, or an appropriately shaped contrast region or outline if light amplification only, and/or some combination of criteria for a 'fusion' image. If such a 'blob' is at the firing point, the weapon immediately fires. If not, the operator continues to depress the trigger, and tries to aim at the target. As the weapon's POI passes through a 'blob' of the desired criteria, the fire control automation of this invention may observe/estimate the 'center of mass' of the target, and may observe the speed (and/or acceleration) at which the weapon POI is passing through that center of mass. As the point-of-impact passes through the point of closest approach to the center of mass (and/or within the target 'blob' by some margin), this invention fires the weapon.

The moment of release may anticipate that POI crossing, to allow for firing delay such as 'locktime' (the time required for electronic sear release, hammer fall, ignition, and projectile launch) and so cause the actual projectile to exit the weapon at the desired moment.

Note that the term 'blob' is used herein to designate the target as seen by the invention. The invention may use a variety of imaging resolutions in various embodiments, and may use DSP-based approaches (digital signal processing) such as contrast enhancement and edge detection to identify and/or outline the area (or point) occupied by the target. In heavy weapons embodiments, it may include radar, lidar, ranging, or other sensors as available—which may yield a point or area for the target, as well as information needed to adjust the POA so the projectile will intersect the target in three dimensions and/or including motion.

In the example of a thermal riflescope, targets may be at relatively long range, and more than one target 'blob' may be in the field of view. This invention may track all such 'blobs' or one(s) somehow designated by the operator, and fire as the weapon point of impact passes through any appropriate 'blob', such as [404], [405], [406], [407] in FIG. 4.

If the weapon is a semi- or full-automatic, successive rounds or bursts may be released each time the weapon POI passes a blob, so targets may be engaged by holding the trigger down and passing the POI through the (single or multiple) targets.

At closer range, a single blob may fill the entire field of view, and the weapon would fire even as the blob fills the field of view. So the center of mass might not be accurately estimated. In one embodiment the sensor or enhanced vision device may have variable magnification to reduce the effects of this problem.

At relatively close ranges, a wider field-of-view enhanced vision device (and/or lower resolution) may be used (with a pistol or submachine gun, for instance). In such an example, the operator depresses the trigger and can 'sweep' across the target(s). The weapon fires a round or burst as the weapon passes each successive target until the trigger is released.

The advantages of this invention include fewer wasted rounds (and therefore possibly greater stealth) and/or enhanced probability of hits at long ranges. At short ranges, when compared to long (manually fired) full automatic bursts, fewer missed rounds would be fired, reducing the frequency of reloading, and fewer rounds would be fired into possibly inadequate backstops, reducing the danger to unintended targets.

With a pistol, the operator could place the first round on target quickly, by depressing the trigger as the POI clears his own body, and the weapon would trigger one or more rounds as the drawn weapon sweeps the target, and returns to it after recoil recovery.

Note that with a pistol example and/or in other embodiments, should this invention not identify a target for whatever reason, an alternate means of manual firing may be retained by the weapon. A pistol, for example may be set up to utilize this invention if the trigger is pulled, or fire anyway if the trigger is pulled farther, and/or harder, or by pulling a 'manual' trigger or another activation device. Thus this action defeats or cancels operation of the weapon in the automatic mode contemplated by the present invention. It also allows small arms to be fired when this invention is inoperable or inappropriate, for whatever reason.

When firing from a moving vehicle, the invention would discharge the weapon only when POI is passing through target(s), reducing fired rounds, misses or wildly fired rounds, recoil recovery time, and ammunition consumption.

To the military, reduction in ammunition consumption is a significant factor. It is commonly believed that in Vietnam, for instance, the number of rounds expended was in the thousands for each hit. "Spray and Pray" firing was typical. Indeed, there may be times when targets are obscured by cover, and automated fire using this invention may be less effective, but in urban or desert encounters, where a target provides a clear contrast, wasted ammunition may be greatly reduced.

In urban encounters, for instance, when a target hides in a doorway or window, pops out to fire, then hides again, the current invention would allow the weapon operator to simply aim at the window or doorway, depress the component that activates the automatic firing mode, and wait. As the target pops back into view, the sensor determines the presence of the target at the point of impact, and the weapon controller fires the weapon, thereby engaging the target without warning to the weapon's operator or his target.

Another related application would be to use weapons equipped with this invention as a booby trap. The military routinely uses tripwires around a camp to set off flares, mines, or other devices. Placing weapons equipped with the current invention to form a perimeter around a camp, aimed at an appropriate height, and enabled to shoot at any target 'blob' having appropriate characteristics passing through their point of impact, might prove to be a useful, difficult to bypass security measure to form a barrier or perimeter. For temporary, overnight camps, the same weapons carried by troops during the day could protect them, unattended, by night. Alternately, smaller (perhaps pistol caliber with silencer) weapons could be utilized for such purposes to avoid giving away a temporary camp position in the event of a false alarm caused by wildlife.

Note too that the target 'blob' in the case of a human may have a variety of shapes, as illustrated in FIG. 3 and FIG. 4. The outline (and detail as a result of range) provided by a standing, sitting, prone, or partially shielded/hidden target would be quite different, so an algorithm akin to 'center of mass' may be used to choose the firing instant. As available computing power increases, the invention may be able to recognize the human (or other target) form, and fire only when a hit of the desired quality (chosen perhaps by the operator) is to be obtained. For instance, a standing human target may be ignored until the POI passes the head and/or torso. Note that in some embodiments, including but not limited to small arms with thermal or 'fusion' riflescopes, a human target (as an example) may show up as a series of closely spaced, but not contiguous, hot spots, as in FIG. 4. A man observed thermally may show a head and arms, but no thermal hot spot for the torso, if obscured by such things as backpacks or body armor. The current invention may include image processing software to link such signatures, blobs, and/or outlines into a single perceived 'target' or 'blob' and fire not at the arms, but the centroid or other estimate of the center and/or vital areas of the target, or to identify the head only as the target, to avoid uselessly shooting into body armor, for instance. Many embodiments are possible, depending upon anticipated target characteristics, and varying objectives (wound vs. kill). Likewise, vehicle targets may be identified by a motor thermal signature, and light amplification imaging may be used to identify the central (occupied) portion of the vehicle, though thermally colder, as the target region or 'blob'. In cases where the image is being analyzed in such a manner, the weapon MAY NOT fire upon passing into any part of the target, instead only firing upon the selected or calculated preferred target zone.

The modification to typical weapons in service today to implement the present invention may be relatively minor. M-16, AR-15 or other small arms may require a modification to the trigger group to allow electronic sear release, and the addition of a thermal (thermal/light amplification fusion, or other) riflescope. Such riflescopes are currently available with video output (NTSC for instance) which may be used as input to this invention, as might other formats and resolutions. The sensing/controlling features of the invention may initially be a separate electronic module placed somewhere in or on the rifle. Other embodiments may be included in the rifle or scope, possibly with electrical connections being made through a (possibly quick release) scope mount, eliminating external cords. Wireless interconnect is also possible. Other embodiments would give the operator (possibly visual) feedback as to the target(s) 'blob(s)' identified by the invention as firing targets, and possibly a corrected aiming point. Note that the term 'rifle' herein is illustrative, not limiting, of small/medium arms, and may include pistols, shotguns, tripod/vehicle mounted heavy machine guns, grenade launchers, etc., as appropriate. In some embodiments, it may include heavier weapons.

In other embodiments, the operator may have the option to identify and/or designate particular target(s) among many in the field of view, with a reticle, dot, or other visual designator presented to the operator, and moved from one observed target 'blob' to another using a 'bump switch' joystick, or other appropriate method. Once designation(s) have been accomplished, the operator depresses the trigger, and could pass through undesignated blobs without firing, but would fire on the designated one(s). This mode may be appropriate in urban settings, for instance, when a hostile target is among bystanders that should not be harmed.

Heavy machine guns, for example the 0.50 cal vehicle mounted machine gun, could also benefit from use of the present invention. The operator could depress the trigger, and the gun fires only as his wavering POI from a moving vehicle passes through a target 'blob'. In the case of such medium weapons, the desired target could include nonhuman ones, such as a hot truck engine, or a cold vehicle, for instance. Various embodiments may choose targets in different manners, as appropriate to the application.

A (for example, thermal) threshold adjustment (automatic and/or manual) and/or contrast enhancement and/or target outline and/or other methods may be included to make desired targets stand out better to the operator and this invention, and if the operator display permits, one or more POI highlights may be presented (as targets are identified by the invention) and/or highlighted (area or outlines) of 'blobs' may be presented to the operator to indicate targets identified by this invention as those that could/would be fired upon. For example, such highlighting may prevent unintentional fire at a warm/cold object near the one the operator wishes to fire upon.

For very heavy weapons, such as cannons firing from moving tanks, vehicles or aircraft, this invention may obviate the need for full weapon stabilization, with associated complexity, cost, and maintenance. This invention may also allow its use as a backup mode when stabilization fails, so a main gun on a tank, for example, could still fire on the move in the event stabilization has failed or when it is overwhelmed by vehicle motion.

In some cases, this invention may create its target 'blob' (which may be highlighted to the operator) in response to external designation, as with a sniper's observer, or an external (such as IR laser) designator. Automatic range-finding may be included in calculating firing POI, to better compensate for range, and rate of firing platform and/or target motion may be used to calculate the required target lead. Such enhancements may result in a highlighted aiming point being displayed to the operator, so he may best direct his wavering weapon to the (corrected) POI.

The visual display could also be routed to a helmet-mounted or similar display, allowing accurate firing upon targets without sighting along the weapon itself, or exposing the operator from behind cover. External designation could also include such things as helmet mounted displays/sights/designators to allow infantry to fire from the hip, without actually sighting along/through the sights of a pistol, rifle, shotgun, or similar device, and to share targets more quickly (for example, via a shared video/targeting feed), allowing multiple troops to engage multiple targets together. Even without designation, this invention could be used to fire without 'deliberately' aiming, as with waving a weapon around a corner or cover without actually exposing the operator—though the latter increases the chance of firing upon undesired or friendly targets.

IFF (Identify Friend or Foe) may also be included in the current invention embodiments. For instance, an infrared beacon as simple as a flashing IR LED snapped to a 9V battery, worn about the body, has been used to identify friendly agents in the field of view of enhanced vision devices. This invention may include a mechanism or algorithm to prevent firing upon friendly targets carrying/wearing appropriate IFF.

As another non-limiting example, one can consider air-to-air combat with cannons fixed to the airframe of a fighter jet. Current technology provides a heads-up-display to a pilot based on parameters such as relative and absolute velocity, range to target, and other parameters, which provides an aiming point (actually an estimated POI) to a pilot. He must maneuver the airframe to match that (corrected) aiming point to the target, and press a trigger to fire the cannon as the aiming point passes through that target, often wasting up to 60 rounds/second off-target, with a very limited ammunition supply (usually a few hundred rounds). The key point is that the pilot must trigger a burst as his aiming point (in this case, predicted impact point relative to the target) passes through the target.

According to the current invention, a pilot may depress the trigger BEFORE the designated target passes through the aiming solution displayed by radar/lidar/enhanced vision, or other sensor(s), and as the target passes through a designated proximity of the predicted impact point, a round/burst is fired automatically. This invention thus allows the pilot to designate the target(s), pull (and hold) the trigger, and concentrate on flying. When the pilot manages to get the target to pass the predicted cannon projectile flight path, the airframe mounted cannon fires a round or a burst, and ceases fire when the target moves outside the designated proximity, or when the trigger is released. The number of wasted rounds is greatly reduced, as the pilot is not required to 'walk' a burst through the target, he merely needs to pull the trigger, hold it, and aim or 'pull through' the target (once or several times), letting the current invention decide when to begin and end firing. Similarly, this invention could be utilized in air-to-ground applications, as well as release rockets/missiles automatically (possibly based upon target lock parameters), instead of cannon or projectile fire.

Figure 5:
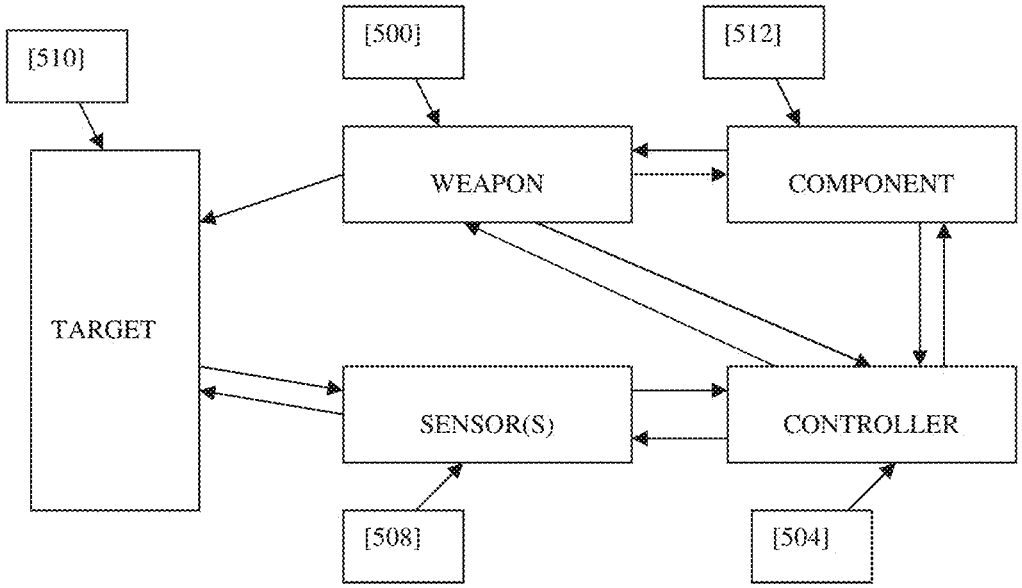
FIG. 5 illustrates a block diagram of the elements of the invention.

FIG. 5 illustrates the principal components of the system of the present invention. A weapon 500 is controlled to fire by a controller 504 when a sensor 508 determines that the point of impact is on a target 510. To enable the system, a component 512 must first be placed in an enable configuration or otherwise signal the controller 504 that the weapon is enable to fire when the target 510 (or an identified region of the target) enters the point of impact.

There exists a deployed weapons system, Phalanx, (and perhaps others not known to the inventor) that superficially resembles the current invention, but with important differences. Phalanx contains a Ku band radar, as well as a monopulse tracking radar, which allows it to autonomously acquire, prioritize, track, and destroy a target. Based upon unclassified literature, the engagement criteria and engagement cycle is as follows:

Phalanx Engagement Criteria

1. Is the range of the target increasing or decreasing relative to the ship? Phalanx discards outbound targets. Only inbound targets are considered.
2. Can the contact maneuver to hit the ship? Phalanx considers target heading in relation to the ship and its speed when determining whether it can hit the ship.
3. Does the target speed fall within engagement minimum and maximum speeds? Phalanx will not engage targets outside these minimum and maximum limits. However, the operator can adjust the limits manually.

Phalanx Engagement Scenario

1. Phalanx is turned ON and in AUTO mode, with its magazine loaded and ammunition fed to the gun.
2. Search radar acquires inbound threat at 10 miles; Phalanx software starts track, assigns priority.
3. Search radar continues track; software confirms threat; fire control radar locks onto target at 5 miles.
4. About 2 miles (or at optimal range assigned by software) gun opens fire on Threat 1 and continues until a hard or soft kill is achieved.
5. Phalanx switches to engage Threat 2 or ceases fire.
6. Phalanx continues to search for threats.

The current invention is fundamentally different from such systems in that:

1. While the current invention may utilize radar-provided or other data to improve better POI estimation accuracy in applications such as aircraft, the preferred embodiment of the current invention utilizes enhanced vision and/or heads-up display, so that the operator has visual contact with the target(s) before engagement. Even in the case of fighter aircraft, a heads up display will likely provide visual contact and an aiming point for the target before firing. Later versions of Phalanx do have IR boresight cameras to assess kills, and to manually aim at and engage small boats, etc. But, such IR cameras are NOT used by Phalanx to automatically fire upon a target.
2. According to the current invention, the operator aims the weapon, though it may or may not be stabilized for firing platform motion, as might be the case on a ship. Target identification, selection and aiming is not fully automatic, as with Phalanx.
3. The operator must enable the weapon prior to (and in the preferred embodiment, during) firing upon the target(s)—it cannot autonomously acquire/assess and fire upon any target without operator authorization, in the form of a trigger pull or other manual enabling control prior to or as the target passes through the POI.
4. The current invention is applicable to small arms, and lightweight, battery operated applications, and/or using prior art enhanced vision riflescopes. Small/medium arms up through Pintle mounted machine guns, such as the 50 cal BMG, have very little or nothing in common with fully automated systems such as Phalanx.
5. Heavier weapons, including vehicle/aircraft/ship mounted cannons, motion stabilized or not, to this day require the operator to manually trigger the firing instant. Availability of additional ballistic POI prediction information, and a point of impact calculated by a fire control computer is in fact prior art, but the current invention is a paradigm shift to autonomous triggering of the firing instant, though the operator may be holding down a trigger or other firing switch, to relieve the operator of split-second judgements as to the firing instant, and increase likely hit rate, especially with non-motion stabilized weapons.
6. The current invention may be used as a backup mode for self-targeting or motion stabilized weapons in the event of a failure or malfunction. As a non-limiting example, a main battle tank could use this invention to engage a target (perhaps while in motion) if the cannon stabilization system fails, and the POI is wavering significantly with respect to the target.
7. The current invention, unlike the automated targeting and fire control of Phalanx, may be used to fire upon any target, moving or not. Phalanx's automation disregards all radar returns from stationary 'clutter'. When firing upon stationary or slow moving objects such as small boats, Phalanx is a manually operated cannon with FLIR sights.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth. In addition, modifications may be made to adapt a particular situation to the teachings of the present invention without departing from its essential scope thereof. Therefore, it is intended that the invention not be limited to the particular embodiment(s) disclosed as the best mode contemplated for carrying out this invention, but that the invention will include all embodiments falling within the scope of the appended claims.

What is claimed is:

1. A device to control autonomous firing of a weapon at a target, said device comprising:

a controller for controlling operation of the device, the device controlling the weapon to fire according to a manual fire mode or an automatic fire mode;

a sensor for determining when a point of impact (POI) of a projectile fired from the weapon passes through a region of the target by contrasting a characteristic of the target or the region of the target from a background;

a component for enabling the weapon in either the manual fire mode or the automatic fire mode;

in the manual fire mode, the weapon can be fired immediately;

in the automatic firing mode, the controller causes the weapon to fire:

when the weapon is enabled to the automatic fire mode, and when the point of impact (POI) of the projectile fired from the weapon passes through the region of the target, and when the controller determines that the target satisfies a "shoot" criterion;

wherein the point of impact (POI) of the projectile fired from the weapon is adjustable relative to a point of aim (POA) by an operator; and wherein the weapon ceases to fire when the target leaves the POI of the projectile fired from the weapon and when the weapon is in the automatic fire mode, and the weapon resumes firing when a target is at the POI of the projectile fired from the weapon and when the weapon is in the automatic fire mode.

2. A weapon for firing a projectile at a target, the weapon comprising the device of claim 1, wherein the POI of the projectile fired from the weapon accounts for delays between a first time when a projectile is released from the weapon and a second time when the projectile strikes the target.

3. The weapon of claim 2, wherein the component for enabling the manual fire mode or the automatic fire mode comprises a switch further comprising a trigger.

4. The weapon of claim 2, wherein the sensor comprises at least any one of an enhanced vision sensor, a ranging sensor, radar, a wind data sensor, a motion sensor, a thermal sensor, a forward-looking infrared radar, and a lidar.

5. The weapon of claim 2, wherein the sensor is adapted for determining when a target satisfies the "shoot" criterion.

6. The weapon of claim 2, wherein the "shoot" criterion comprises a thermal signature consistent with the target.

7. The weapon of claim 6, wherein the target comprises a vehicle target, and wherein a thermal signature of the vehicle target comprises at least one of an engine and another vehicle component, and wherein the thermal signature is consistent with one of a heat and a shape of at least one of the engine and the another vehicle component.

8. The weapon of claim 2, wherein the controller determines a projectile firing time based on a delay between causing the weapon to fire and release of a projectile from the weapon, the delay comprising ignition lock time.

9. The weapon of claim 2, wherein the sensor is further adapted to determine an outline of the target based on at least one of a visible, infrared, or fusion image of the target, said outline for use in determining when the point of impact of the projectile fired from the weapon passes through a region of the target using at least one of target contrast enhancement and target edge detection.

10. The weapon of claim 2, wherein the region of the target has a thermal signature consistent with one of a heat and a shape of the region.

11. The weapon of claim 2, wherein the target comprises a plurality of elements, and wherein the region of the target comprises one of the plurality of elements.

12. The weapon of claim 2, wherein the vehicle "shoot" criterion includes a designation of whether the target is friend or foe.

13. The weapon of claim 3, wherein the trigger is configured to be moved to enable the automatic firing mode and wherein an additional actuation of the trigger by the operator enables the manual fire mode.

14. The weapon of claim 2, wherein the weapon is mounted on a first vehicle and wherein the target is a second vehicle different from the first vehicle.

15. The weapon of claim 2, wherein the controller calculates the POI of the projectile fired from the weapon at a target range based upon the point of aim, and based upon one or more of ballistic information, range, absolute weapon and target velocities, relative weapon and target velocities, absolute weapon and target accelerations, relative weapon and target accelerations, angles between the weapon and the target, and higher order derivatives of absolute and relative weapon and target motions.

16. The weapon of claim 15, wherein the point of aim is a point at which a sight of the weapon is centered and an axis at which a bore of the weapon is directed.

17. A method for firing the projectile at the vehicle target using the weapon of claim 2, said method comprising:

manually setting, by the operator, the component to the automatic firing mode;

adjusting, by the operator, the point of aim (POA) of the weapon;

determining, with the sensor, when the point of impact (POI) of the projectile fired from the weapon passes through the region of the target;

determining that the target satisfies "shoot" criterion a; and firing of the weapon.

18. The device of claim 2, wherein the point of impact of the projectile fired from the weapon is determined based on the point of aim and one or more additional factors comprising a time delay and trajectory of a round after the round leaves the weapon, target range, relative velocity and acceleration of the target and a weapon platform, projectile drop, wind speed and direction, temperature, and relative humidity.

19. The weapon of claim 2, wherein the target comprises a wheeled or tracked land vehicle, a watercraft, a hovercraft or an aircraft.

20. The weapon of claim 12, wherein the target is determined to be either a friend or foe when a beacon positioned on the target transmits either a friend or foe designation to the sensor.

21. The weapon of claim 2, wherein the weapon comprises a small arms weapon, and wherein the controller calculates the POI based on the point of aim.

22. A controller for automatic firing a weapon at a vehicle target, said controller comprising:

a sensor for determining when a point of impact (POI) of a projectile fired from weapon passes through a region of the vehicle target by contrasting a characteristic of the vehicle target or a region of the vehicle target from a background;

a component for enabling an automatic firing mode of the weapon;

wherein the controller is adapted to automatically fire the weapon:

when the automatic firing mode is enabled by an operator, when the point of impact (POI) of the projectile fired from the weapon passes through the region of the vehicle target, and when the vehicle target satisfies predetermined shoot criteria as determined by the sensor.

23. The device of claim 22, wherein the point of impact (POI) of the projectile fired from the weapon relative to a point of aim is adjustable by the operator.

24. A weapon mounted on an airframe, the weapon comprising:

a controller for automatically firing the weapon at a target as the airframe is moving;

a sensor for determining when a point of impact (POI) of a projectile fired by e weapon passes through a region of the target by contrasting a characteristic of the target or a region of the target from a background of the target;

wherein the controller is adapted to automatically fire the weapon:

when the automatic firing mode is enabled by an airframe operator, when the point of impact (POI) of the projectile fired from the weapon passes through the region of the target, and when the target satisfies predetermined "shoot" criterion as determined by the sensor;

wherein the weapon ceases to fire when the target leaves the POI of the projectile fired from the weapon and the weapon resumes firing when a target is at the POI of the projectile fired from the weapon.

* * * * *